US009860648B2

(12) United States Patent
Pahkala et al.

(10) Patent No.: US 9,860,648 B2
(45) Date of Patent: Jan. 2, 2018

(54) ELEVATOR SYSTEM AND METHOD FOR IMPLEMENTING A SOUND SYSTEM FOR AN ELEVATOR

(71) Applicants: Kari Pahkala, Tervakoski (FI); Matti Kujala, Riihimaki (FI)

(72) Inventors: Kari Pahkala, Tervakoski (FI); Matti Kujala, Riihimaki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 14/611,935

(22) Filed: Feb. 2, 2015

(65) Prior Publication Data

US 2015/0146896 A1 May 28, 2015

Related U.S. Application Data

(63) Continuation of application No. PCT/FI2013/050800, filed on Aug. 15, 2013.

(30) Foreign Application Priority Data

Aug. 17, 2012 (FI) ..... 20125857

(51) Int. Cl.

| | |
|---|---|
| ***H04R 25/00*** | (2006.01) |
| ***H04R 19/00*** | (2006.01) |
| ***B66B 3/00*** | (2006.01) |
| *H04R 19/02* | (2006.01) |
| *H04R 1/02* | (2006.01) |
| *H04R 27/02* | (2006.01) |

(52) U.S. Cl.

CPC ..... *H04R 19/00* (2013.01); *B66B 3/00* (2013.01); *B66B 3/006* (2013.01); *H04R 1/028* (2013.01); *H04R 1/023* (2013.01); *H04R 19/02* (2013.01); *H04R 27/02* (2013.01); *H04R 2201/021* (2013.01)

(58) Field of Classification Search

CPC ..... H04R 19/00; H04R 19/02

USPC ..... 381/191, 116

See application file for complete search history.

(56) References Cited

U.S. PATENT DOCUMENTS 5,551,533 A 9/1996 Ng
8,177,036 B2 5/2012 Stanley et al.
(Continued)

FOREIGN PATENT DOCUMENTS

CN 101263071 A 9/2008
JP H10234100 A 9/1998
(Continued)

OTHER PUBLICATIONS

International Search Report PCT/ISA/210 for International Application No. PCT/FI2013/050800 dated Oct. 14, 2013.
(Continued)

*Primary Examiner* — Sunita Joshi

(74) *Attorney, Agent, or Firm* — Harness, Dickey & Pierce, P.L.C.

(57) ABSTRACT

Improvement to a sound system for an elevator system and method for implementing the sound system for an elevator. The elevator sound system is improved by replacing at least one loudspeaker to be used in the sound system with a plate-like electrostatic actuator producing a directed sound field. The patent application also contains an independent claim for a method for implementing a sound system for an elevator.

7 Claims, 2 Drawing Sheets

(56) References Cited

U.S. PATENT DOCUMENTS

Figure 1:
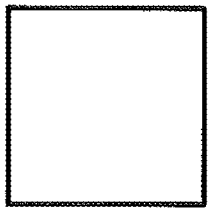

| | | | | |
|---|---|---|---|---|
| 2004/0022409 | A1* | 2/2004 | Hutt | B60R 11/0223 381/423 |
| 2009/0301820 | A1 | 12/2009 | Stanley et al. | |
| 2011/0019845 | A1* | 1/2011 | Kelloniemi | H04R 3/00 381/191 |

FOREIGN PATENT DOCUMENTS

| | | | | |
|---|---|---|---|---|
| JP | 2006347733 | A | 12/2006 | |
| WO | WO-2009127787 | A1 | 10/2009 | |
| WO | WO 2010033103 | A1 * | 3/2010 | B66B 11/0226 |
| WO | WO-2010033103 | A1 | 3/2010 | |

OTHER PUBLICATIONS

Written Opinion of the International Searching Authority PCT/ISA/237 for International Application No. PCT/FI2013/050800 dated Oct. 14, 2013.

Finnish Search Report from Finnish Application No. 20125357 dated Jan. 2, 2013.

* cited by examiner

ELEVATOR SYSTEM AND METHOD FOR IMPLEMENTING A SOUND SYSTEM FOR AN ELEVATOR

This application is a continuation of PCT International Application No. PCT/FI2013/050800 which has an International filing date of Aug. 15, 2013, and which claims priority to Finnish patent application No. 20125857 filed Aug. 17, 2012, the entire contents of both which are incorporated herein by reference.

FIELD OF THE INVENTION

The invention relates to the field of elevator technology and more particularly to the implementation of sound systems to be used in elevators.

STATE OF THE ART

An elevator gong is a sound-producing device to be used in elevator systems, which device announces the arrival and/or direction of an elevator, typically with a typical ping-type sound. An elevator gong is typically disposed in front of the elevator above the door opening.

A lift announcer (ACU) is a sound-producing device to be used in elevator systems, which is used in the lobbies of buildings in the elevator waiting areas but also in the elevators themselves, on the one hand to indicate the elevator serving a customer, particularly if an elevator group comprising a number of elevators is in use, and on the other hand to indicate the disembarkation floor of a customer in the elevator. Lift announcers are generally disposed in a lobby, in which elevators are ordered, and also in the elevators themselves. A lift announcer is also used e.g. in connection with elevators in the platform area for a metro or for trains.

A Destination Operation Panel (DOP) is a system for ordering elevators to be used especially in high-rise buildings, in which system a customer is notified of the code of the elevator to transport him/her in advance when he/she orders the elevator.

In the following, we refer to an elevator gong, to a lift announcer and to a destination operation panel with the term "elevator sound system".

An elevator sound system is a part of an elevator system, which is a particularly important part to the visually impaired and to people with poor eyesight. Standard ISO 4190-5:2006 "Lift (Elevator) installation—Part 5: Control devices, signals and additional fittings" presents certain technical requirements that also concern a sound system, inter alia that the sound level to be required of an elevator sound system is 80 dB(A).

The sound produced by an elevator sound system can, of course, be considered a source of noise in certain operating situations. More particularly in hospitals, retirement homes, hotels and public areas, such as the platform areas for a metro or for trains, it is desirable that it is possible to reduce the production of unwanted sounds (i.e. noise). Noise disturbs in particular the hearing impaired and people with poor hearing.

As background noise increases, identifying the direction of a sound becomes difficult. If an elevator group comprises more than one elevator, the usability of an elevator sound system deteriorates, because in this case it is difficult to distinguish elevator sound systems from each other.

Owing to the aspects presented above, meeting the requirements of standard BS EN 81-70:2003 "Safety rules for the construction and installation of lifts. Particular applications for passenger and goods passenger lifts. Accessibility to lifts for persons including persons with disability" is difficult to implement in a way that also meets the requirements of the ISO 4190-5:2006 standard.

AIM OF THE INVENTION

The aim of the invention is to improve the usability of an elevator sound system in such a way that it is possible to meet the requirements of standard BS EN 81-70:2003 while at the same time meeting the requirements of the ISO 4190-5:2006 standard.

This aim can be resolved with an elevator sound system according to claim 1 and with the method according to claim 9 for implementing an elevator sound system.

The dependent claims describe preferred embodiments of the invention.

Advantages of the Invention

For implementing in an elevator sound system the improvement according to the invention, at least one loudspeaker to be used in the elevator sound system is replaced with a plate-like electrostatic actuator producing a directed sound field. The improvement solves the disturbances to the environment that are caused by the sound of an elevator sound system, because the sound can be delimited to a predefined area. At the same time we also enable amplification of the sound volume. The sound level remains at essentially the same level throughout the whole listening area.

When the plate-like electrostatic actuator is covered with netting, an elevator and its operating environment can be made aesthetically pleasing regardless of the external appearance of the actuator, because the netting in practice masks the actuator. The netting allows sound through, however.

When the netting is steel netting or comprises steel netting, the vandal resistance of an elevator can be improved. This is important for fulfilling the requirements of European standard EN81-71 "Safety Rules for the Installation of Lifts—PART 28: Vandal Resistant Lifts". Owing to the steel netting, an elevator sound system can be made to fulfill the requirements of Category 1 presented in the standard (i.e. an elevator sound system must withstand a 4 J dynamic impact).

When a plate-like electrostatic actuator is installed on the ceiling, and/or wall or door of the elevator car, space is saved because the plate-like electrostatic actuator does not contain a cone that would take up a lot of space in the depth direction. In this way an elevator car can be made to be more compact in its dimensions or the extra space can be utilized for enhancing ride comfort.

When at least two plate-like electrostatic actuators are used to divide the elevator car into at least two listening areas, the sound to be produced in an elevator car can be kept better understandable and still the sound can be produced sufficiently strongly for each listening area.

When a plate-like electrostatic actuator is installed outside the elevator above the door, the waiting area of an elevator and the environment of the waiting area can be implemented to be quieter. Owing to this less noise is produced into the environment of an elevator sound system and, additionally, the comfort and reliability of use of the elevator sound system can be improved, particularly in respect of elevator users with impaired hearing.

When at least two plate-like electrostatic actuators are used to divide the area outside the elevator car into at least two listening areas, the sound to be produced in an elevator car can be kept better understandable and still the sound can be produced sufficiently strongly for each listening area.

As explained in the preceding, the elevator sound system comprises at least one of the following: an elevator gong, a lift announcer, a destination operation panel.

In the method for implementing a sound system for an elevator, a sound is produced with an elevator sound system improved according to any of claims 1-8.

LIST OF DRAWINGS

The invention is disclosed in the following in more detail by the aid of illustrative embodiments presented in the appended FIGS. 1-4.

Figure 2:
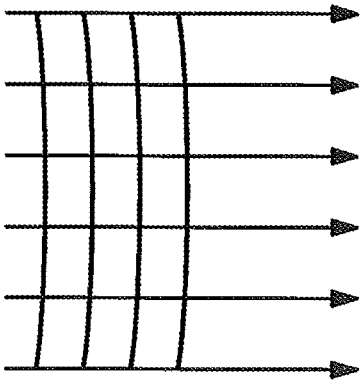
Figure 3:
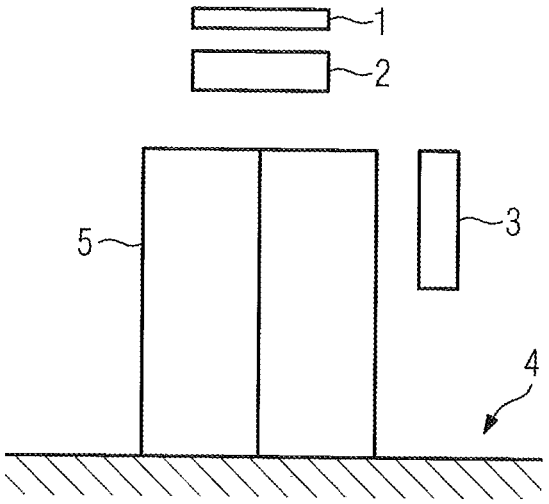
Figure 4:
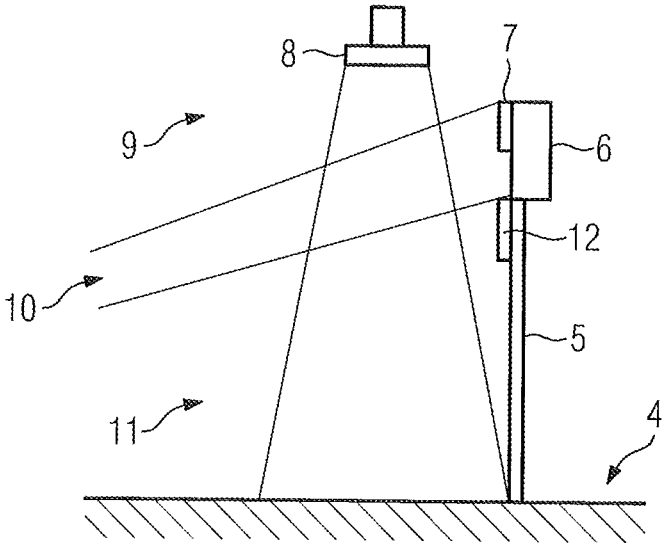

FIG. 1 presents the distribution of sound coming from a plate-like electrostatic actuator producing a directed sound field as viewed from above;

FIG. 2 presents the distribution of sound coming from a plate-like electrostatic actuator producing a directed sound field as viewed from the side;

FIG. 3 presents an improvement to an elevator sound system in the waiting areas of an elevator; and FIG. 4 presents an improvement to an elevator sound system in an elevator car.

In all the FIGs the same reference numbers refer to the same technical features.

DETAILED DESCRIPTION

Known from Panphonics Oy's international patent publication WO 2009/127787 is a plate-like electrostatic actuator producing a directed sound field. The plate-like electrostatic actuator producing a directed sound field presented in our present application can be more particularly the actuator described in the aforementioned patent application publication or an actuator of similar type, more particularly we use the "Sound Shower" arrangement as defined in Panphonics Oy's "Company and technology presentation" (August 2011).

The directivity of the sound field in the actuator described in patent application publication WO 2009/127787 is based on a delay directing a sound field being formed with an RC circuit, which is at least partly composed of components of the electrostatic actuator. The electrostatic actuator itself functions as the capacitor of the RC circuit, because the stators are so close to each other that the capacitance of the electrostatic actuator forms to be quite high. In embodiment types having only one stator, capacitance forms between the stator and the diaphragm.

FIG. 1 presents the distribution of sound coming from a plate-like electrostatic actuator producing a directed sound field as viewed from above, and FIG. 2 as viewed from the side. It is characteristic to the direction distribution of the sound that the sound is audible in front of the actuator but not at the side of it. The sound volume in front of the actuator is almost constant in the whole listening area.

FIG. 3 presents an elevator door 5 in a corridor 4, which is a corridor or lobby at the operating site of an elevator. According to a first aspect of the present invention, above the door 5, e.g. on the ceiling, is a first plate-like electrostatic actuator 1 producing a directed sound field, a second plate-like electrostatic actuator 2 producing a directed sound field, and a third plate-like electrostatic actuator 3 producing a directed sound field.

The second 2 actuator can be situated e.g. above the elevator door itself.

The third actuator 3 can be disposed in the car operating panel of the elevator, or in connection with it. Buttons for ordering an elevator and/or lights or other identifiers indicating the state of the elevator, or the door 5 of it, for example, are generally arranged in the operating panel or in connection with it.

FIG. 4 presents a view in an elevator car, which for the sake of clarity is presented at the same floor level as the floor 4 of FIG. 3. The elevator car can be moved in relation to the floor 4 up and down in the elevator hoistway.

According to the second aspect of the invention, in the elevator car is a first plate-like electrostatic actuator 7 producing a directed sound field, a second plate-like electrostatic actuator 12 producing a directed sound field, and a third plate-like electrostatic actuator 8 producing a directed sound field.

The first actuator 7 is disposed on the wall 6 of the elevator. The second actuator 12 is disposed on the door 5 of the elevator car. The third actuator 8 is disposed on the ceiling of the elevator.

The first actuator 7 forms a first listening area 10, the second actuator 12 forms a second listening area 9, and the third actuator 8 forms a third listening area 11.

The arrangement according to FIG. 4 (FIG. 4) can be applied in the waiting lobby of an elevator, e.g. in such a way that the actuator 8 of FIG. 4 corresponds to the actuator 1 of FIG. 3, the actuator 7 corresponds to the actuator 2 of FIG. 3 and the actuator 12 corresponds to the actuator 12.

According to what is presented above, by means of the improvement according to the invention a delimited area for sound can be formed in an elevator car and in an elevator waiting area. At the same time amplification of the sound is possible. It is possible to keep the intensity of the sound essentially the same throughout the listening area.

Installation of the arrangement is easy, because recesses for loudspeaker cones do not need to be made in the elevator car. It is sufficient that a hole is made for the lead and for the fixing in the wall of the elevator car or in the corridor.

The invention must not be regarded as being limited only to the claims below but instead should be understood to include all legal equivalents of said claims.

The invention claimed is:

1. A sound system for an elevator, comprising:

a plurality of plate-like electrostatic actuators configured to produce a directed sound field near or inside of an elevator car, the plurality of plate-like electrostatic actuators including a first electrostatic actuator installed on a wall of the elevator car, a second electrostatic actuator on a door of the elevator car, and a third electrostatic actuator on a ceiling of the elevator car, wherein the first electrostatic actuator configured to produce a directed sound field in a first listening area in front of the first electrostatic actuator, the second electrostatic actuator configured to produce a directed sound field in a second listening area in front of the second electrostatic actuator, and the third electrostatic actuator configured to produce a sound field in a third listening area in front of the third electrostatic actuator, the first listening area, the second listening area and the third listening area intersecting within the elevator car such that the directed sound field in front of the plurality of plate-like electrostatic actuators is constant in an entire listening area within the elevator car, and the plurality of plate-like electrostatic actuators are covered with a steel netting, in which the steel netting is able to withstand a dynamic impact force of at least 4 J.

2. The sound system according to claim 1, wherein at least one plate-like electrostatic actuator is configured to be installed outside of the elevator above or beside a door of the elevator car.

3. The sound system according to claim 2, wherein at least two plate-like electrostatic actuators are used to divide an area outside the elevator car into at least two listening areas.

4. The sound system according to claim 1, further comprising:

an elevator gong, a lift announcer, and a destination operation panel.

5. A method for implementing a sound system for an elevator, comprising:

replacing a plurality of loudspeakers in the elevator with a plurality of plate-like electrostatic actuators to produce a directed sound field near or inside of an elevator car;

installing a first electrostatic actuator on a wall of the elevator car, a second electrostatic actuator on a door of the elevator car, and a third electrostatic actuator on a ceiling of the elevator car, the first electrostatic actuator configured to produce a directed sound field in a first listening area in front of the first electrostatic actuator, the second electrostatic actuator configured to produce a directed sound field in a second listening area in front of the second electrostatic actuator, and the third electrostatic actuator configured to produce a sound field in a third listening area in front of the third electrostatic actuator, the first listening area, the second listening area and the third listening area intersecting within the elevator car such that the directed sound field in front of the plurality of plate-like electrostatic actuators is constant in an entire listening area within the elevator car; and covering the plurality of plate-like electrostatic actuators with a steel netting, wherein the steel netting is able to withstand a dynamic impact force of at least 4 J.

6. The method according to claim 5, further comprising:

installing at least one plate-like electrostatic actuator outside of the elevator above or beside a door of the elevator car.

7. The method according to claim 6, wherein at least two plate-like electrostatic actuators are used to divide an area outside the elevator car into at least two listening areas.

* * * * *